US007068142B2

(12) United States Patent
Watanabe et al.

(10) Patent No.: US 7,068,142 B2
(45) Date of Patent: Jun. 27, 2006

(54) PRESSURE-SENSITIVE RESISTOR AND PRESSURE-SENSITIVE SENSOR USING THE SAME

(75) Inventors: Tomoyasu Watanabe, Kariya (JP); Kenichi Yanai, Nisshin (JP); Masashi Totokawa, Nagoya (JP); Yuuichi Sekine, Yokkaichi (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/808,543

(22) Filed: Mar. 25, 2004

(65) Prior Publication Data

US 2005/0128047 A1 Jun. 16, 2005

(30) Foreign Application Priority Data

Mar. 25, 2003 (JP) ..... 2003-082761

(51) Int. Cl.
*H01C 10/10* (2006.01)

(52) U.S. Cl. ..... 338/47; 338/99; 338/114

(58) Field of Classification Search ..... 338/47, 338/99, 101, 114
See application file for complete search history.

(56) References Cited

U.S. PATENT DOCUMENTS

| | | | | | |
|---|---|---|---|---|---|
| 3,629,774 | A | * | 12/1971 | Crites | 338/114 |
| 3,719,913 | A | * | 3/1973 | DuBose et al. | 338/2 |
| 4,268,815 | A | | 5/1981 | Eventoff | |
| 4,276,538 | A | | 6/1981 | Eventoff | |
| 4,301,337 | A | | 11/1981 | Eventoff | |
| 4,314,227 | A | | 2/1982 | Eventoff | |
| 4,314,228 | A | | 2/1982 | Eventoff | |
| 4,315,238 | A | | 2/1982 | Eventoff | |
| 4,489,302 | A | | 12/1984 | Eventoff | |
| 4,794,365 | A | * | 12/1988 | Dunbar | 338/99 |
| 4,996,511 | A | * | 2/1991 | Ohkawa et al. | 338/114 |
| 5,989,700 | A | * | 11/1999 | Krivopal | 428/323 |
| 6,072,130 | A | * | 6/2000 | Burgess | 200/86 R |
| 6,121,870 | A | * | 9/2000 | Ariga et al. | 338/114 |
| 6,388,556 | B1 | * | 5/2002 | Imai et al. | 338/114 |
| 2003/0143409 | A1 | * | 7/2003 | Di Stefano | 428/447 |

FOREIGN PATENT DOCUMENTS

| | | |
|---|---|---|
| JP | A-2001-99726 | 4/2001 |
| JP | A-2003-106912 | 4/2003 |

OTHER PUBLICATIONS

JP-A-2003-106912 macchine language translation Apr. 9, 2004.*

* cited by examiner

*Primary Examiner*—Tu Hoang
(74) *Attorney, Agent, or Firm*—Posz Law Group, PLC

(57) ABSTRACT

A pressure-sensitive sensor includes two base films opposite to each other, a pair of electrodes provided on the two base films, and first and second pressure-sensitive resistors provided by two layers on the electrodes to form a predetermined gap therebetween. Further, a contact state between the first and second pressure-sensitive resistors is changed in accordance with a pressure applied to at least one of the base films, and a resistance between the electrodes is changed in accordance with the contact state between the pressure-sensitive resistors. In addition, each of the pressure-sensitive resistors is constructed with a binder resin having an elasticity modulus in a range between 10 and 1000 Mpa, and electrical conductive particles each of which is coated with a polymer. Accordingly, the pressure-sensitive sensor including the pressure-sensitive resistors can accurately detect a pressure in a range between 1 and 20 kPa.

15 Claims, 3 Drawing Sheets

PRESSURE-SENSITIVE RESISTOR AND PRESSURE-SENSITIVE SENSOR USING THE SAME

CROSS REFERENCE TO RELATED APPLICATION

This application is based on Japanese Patent Application No. 2003-82761 filed on Mar. 25, 2003, the disclosure of which is incorporated herein by reference.

BACKGROUND OF THE INVENTION

1. Field of the Invention

The present invention relates to a pressure-sensitive resistor and a pressure-sensitive sensor having the pressure-sensitive resistor.

2. Description of the Related Art

As a pressure-sensitive sensor has been known a sensor using a volume resistance variation in a resistor when pressure is applied to the resistor ("SENSOR TECHNIQUE", Vol. 19, No. 9, 1989). In this pressure-sensitive sensor, a great deal of pressure must be applied to the sensor to have a large resistance variation rate and thus it is generally unsuitable to detect a low pressure.

JP-A-2003-106912 proposes a pressure-sensitive sensor using a contact resistance variation on the surfaces between electrical contact points. This pressure-sensitive sensor has a pair of electrodes and two layers of pressure-sensitive resistance materials which are formed on the respective electrodes through a predetermined gap. The pair of electrodes and the two layers of the pressure-sensitive resistance materials are provided between a pair of base films. The surface of each electrical conductive particle constituting the pressure-sensitive resistant material is coated by extremely thin polymer. When a pressure is applied to the base films, the contact area between the pressure-sensitive resistant materials is varied in accordance with the applied pressure, and this variation of the contact area causes a variation in true contact area resistance (concentrated resistance) between the electrodes. The true contact area resistance is based on the contact area, and the resistance variation is little observed when the contact area is saturated.

When the pressure-sensitive resistant materials are deformed by the applied pressure in a state where the pressure-sensitive resistant materials contact with each other, the distance between the polymer-coated electrical conductive particles at the contact position between the pressure-sensitive resistance materials is varied. Therefore, the tunnel conduction between the electrical conductive particles is varied and it appears as coating film resistance variation. This pressure-sensitive sensor achieves linear resistance variation in a broad pressure range by using both the resistance variations described above.

However, when pressure of 1 to 20 kPa for a detection of a passenger in a vehicle or for a measurement of a body pressure distribution of a human body is mainly set as a detection range, there may occur such a case that even when an applied pressure is increased, the contact area between the pressure-sensitive resistant materials is not increased because the applied voltage is low. In this case, no true-contact area resistance variation occurs, and thus no linear resistance variation can be obtained in the above pressure range.

SUMMARY OF THE INVENTION

In view of the above-described problems, it is an object of the present invention to provide a pressure-sensitive resistor which can detect a pressure in a range of 1 to 20 kPa with a high sensitivity, and a pressure-sensitive sensor having the pressure-sensitive resistor.

According to an aspect of the present invention, a pressure-sensitive resistor for a pressure-sensitive sensor includes a binder resin having an elasticity modulus in a range between 10 and 1000 Mpa, and a plurality of electrical conductive particles each of which is coated with polymer. Therefore, a true contact-area resistance variation and a coating film resistance variation are generated to correspond to the applied pressure in a pressure range of 1 to 20 kPa. Therefore, the pressure-resistance characteristic of the pressure-sensitive resistor is continuously reduced as the pressure increases, and the resistance variation rate of the pressure-sensitive resistor is large in the resistance-detectable range ($10^6\Omega$ or less). That is, the pressure-sensitive resistor of the present invention can detect the pressure in the range from 1 to 20 kPa with a high sensitivity.

Preferably, the electrical conductive particles are carbon black particles, the electrical conductive particles have a primary particle diameter that is in a range between 8 nm and 300 nm, and an amount of the polymer coated on the electrical conductive particles is in a range between 1 wt % and 70 wt % with respect to a total amount of the electrical conductive particles and the binder resin.

According to another aspect of the present invention, a pressure-sensitive sensor includes first and second base films opposite to each other, a pair of electrodes provided on first and second base films, respectively, between the first and second base films, and first and second pressure-sensitive resistors provided by two layers on the electrodes to form a predetermined gap between the first and second pressure-sensitive resistors. In this case, a contact state between the first and second pressure-sensitive resistors is changed in accordance with a pressure applied to at least one of the first and second base films, the electrodes are provided to change a resistance therebetween in accordance with the contact state between the first and second pressure-sensitive resistors, and each of the first and second pressure-sensitive resistors is constructed with a binder resin having an elasticity modulus in a range between 10 and 1000 Mpa, and a plurality of electrical conductive particles each of which is coated with a polymer. Thus, a pressure in the range from 1 to 20 kPa can be accurately detected.

According to a further another aspect of the present invention, a pressure-sensitive sensor includes first and second base films opposite to each other, a pair of electrodes provided on first and second base films, respectively, between the first and second base films, and a pressure-sensitive resistor provided by one layer on one of the electrodes to form a predetermined gap between the pressure-sensitive resistor and the other one of the electrodes. In this case, a contact state between the pressure-sensitive resistor and the other one of the electrodes is changed in accordance with a pressure-applied to-at least one of the first and second base films, and the electrodes are provided to change a resistance therebetween in accordance with the contact state between the pressure-sensitive resistor and the other one of the electrodes. Further, the pressure-sensitive resistor is constructed with a binder resin having an elasticity modulus in a range between 10 and 1000 Mpa, and a plurality of electrical conductive particles each of which is coated with a polymer. Even in this case, a pressure in the range from 1 to 20 kPa can be accurately detected.

BRIEF DESCRIPTION OF THE DRAWINGS

Other objects, features and advantages of the present invention will become more apparent from the following detailed description made with reference to the accompanying drawings, in which.

DETAILED DESCRIPTION OF THE PREFERRED EMBODIMENT

A preferred embodiment of the present invention will be now described with reference to FIGS. 1–5.

In this embodiment, a pressure-sensitive resistor and a pressure-sensitive sensor are used to detect a passenger in a vehicle, and to measure a body pressure distribution of a human on a bed or the like. The pressure-sensitive resistor and the pressure-sensitive sensor 1 can be used to detect a low pressure (1 to 20 kPa) with a high precision.

Figure 1:
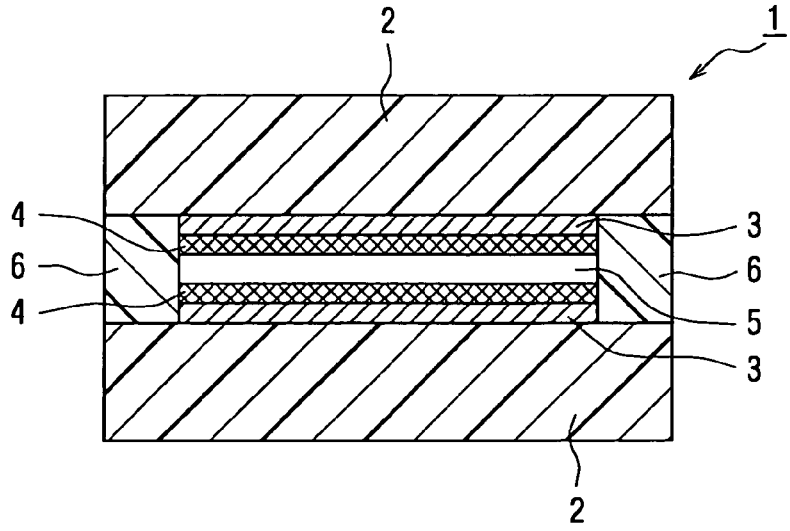
FIG. 1 is a schematic sectional view of a pressure-sensitive sensor according to a preferred embodiment of the present invention.

As shown in FIG. 1, the pressure-sensitive sensor 1 includes first and second base films 2 serving as base materials, a pair of electrodes 3 formed on the respective base films 2, pressure-sensitive resistors 4 formed on the respective electrodes 3 and a spacer 6 for setting a predetermined gap 5 between the pressure-sensitive resistors 4. In this embodiment, the pressure-sensitive sensor has a double-sided structure. In the double-sided structure, the electrode 3 and the pressure-sensitive resistor 4 are formed on each of two base films 2, and the two base films 2 face to each other through the predetermined gap 5. However, the pressure-sensitive resistor 4 of FIG. 1 can be provided on only one electrode 3. Furthermore, the pressure-sensitive sensor can be designed to have a shorting bar structure in which a pair of electrodes 3 are formed on one base film 2 to be spaced from each other at a predetermined interval and a pressure-sensitive resistor 4 is formed on the other base film 2.

The base film 2 can be formed of polyethylene terephthalate (PET), polyethylene naphthalate (PEN), polyether imide (PEI), polyphenylene sulfide (PPS) or other general resin film.

Figure 2:
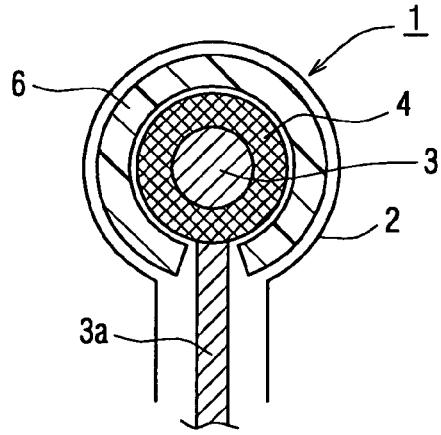
FIG. 2 is a partial-sectional plan view of the pressure-sensitive sensor according to the embodiment.

The electrode 3 is obtained as follows. That is, metal particles of Cu, Ag, Sn or the like is added with a solvent, and kneaded to form a paste or an ink. Thereafter, the paste or the ink thus obtained is subjected to pattern formation on the base film 2 by a screen printing method or an ink jetting method, and is dried. As shown in FIG. 2, a lead 3*a* to be connected to the external is formed together with the electrode 3. FIG. 2 is a plan view of the pressure-sensitive sensor 1 of FIG. 1 which is viewed in the direction from the gap 5 to the base film 2. However, in FIG. 2, for convenience sake of description, a part of the electrode 3 as the lower layer of the pressure-sensitive resistor 4 is illustrated as being seen through the pressure-sensitive resistor 4.

The pressure-sensitive resistor 4 contains electrical conductive particles and binder resin as the constituent material. The constituent material is added with an organic solvent and kneaded to form a paste or an ink, and the paste or the ink thus obtained is pattern-formed so as to cover the surface of the electrode 3 by the screen printing method or the ink jetting method, and then dried. At this time, the paste or the ink is adjusted so that the pressure-sensitive resistor 4 exhibits a linear pressure-resistance characteristic in the pressure range from 1 to 20 kPa and the resistance variation rate (pressure sensitivity) is increased in the resistance-detectable range.

The electrical conductive particles can be formed of metal particles of Ag, Cu or an alloy thereof, a semiconductor oxide such as $SnO_2$ or the like, a carbon black or the like. It is preferable to use a carbon black which has a structure and a functional group such as a carboxyl group, a hydroxyl group or the like on the surface and is liable to be coated with polymer. This embodiment uses the carbon black. Further, polymer is coated on the surface of each electrical conductive particle.

Furthermore, the primary particle diameter (average particle diameter) of the electrical conductive particles is preferably set in a range from 8 nm to 300 nm. More preferably, it is set in a range from 15 nm to 100 nm. In this case, the polymer can be uniformly coated on the surface of each electrical conductive particle.

The polymer is preferably formed of thermosetting resin such as phenol resin, urea resin, melamine resin, xylene resin, diallyl phthalate resin, epoxy resin, urethane resin, benzoguanamine resin or the like. The materials may be used alone or two or more kinds of materials may be mixed and used. Phenol resin, xylene resin and epoxy resin within these thermosetting resin materials are preferable, and particularly epoxy resin is more preferable because it has excellent heat resistance.

The method of coating the electrical conductive particles with the above polymer is not limited to a specific one. For example, the following method can be used. That is, after the blend amount of the electrical conductive particles and the polymer is properly adjusted, the polymer is mixed with and solved in solvent such as cyclohexanone, toluene, xylene or the like to obtain a solution. Furthermore, the electrical conductive particles and water are mixed with each other to obtain a slurry. The obtained solution and the obtained slurry are mixed and stirred, and then the electrical conductive particles and the water are separated from each other. Thereafter, the resultant is heated and kneaded to obtain a composition. Then, the obtained composition is formed in a sheet shape, is pulverized and then is dried. Alternatively, there can be used a method of mixing and stirring the solution and the slurry obtained in the same manner as described above to granulate the electrical conductive particles and the polymer, and then separating the composition thus obtained. Furthermore, there can be used a method of providing reactive functional groups to the surface of each electrical conductive particles, adding polymer to the particles and then dry-blending. Still furthermore, the following method can be used. That is, monomer components having reactive groups constituting polymer and water are stirred at high speed to adjust slurry, polymerized and then cooled to obtain resin having reactive groups from the polymerized slurry. Thereafter, the resultant is added with electrical conductive particles and kneaded to react the electrical conductive particles and the reactive groups, and then the resultant is cooled and pulverized.

As the binder resin can be used a single material or a mixture of two or more materials selected from epoxy resin, polyester resin, phenol resin, amino resin, urethane resin, silicon resin, etc. Preferably, urethane resin is used. In this embodiment, the elastic modulus of the binder resin is set in a range from 10 Mpa to 1000 Mpa, preferably in a range from 10 Mpa to less than 800 Mpa. The effect of the binder resin on the pressure-resistance characteristic will be described later.

As the organic solvent can be used a single material or a mixture of two or more materials selected from ketone type solvent such as methyl ethyl ketone, methyl isobutyl ketone, cyclohexanone or the like, aromatic hydrocarbon type solvent such as toluene, xylene, Solvent 100 (produced by Esso Company) or the like, ester type solvent such as ethyl acetate, butyl acetate, cellosolve acetate or the like, ether type solvent such cellosolve, butyl cellosolve, butyl carbitol or the like, alcohol type solvent such as isopropyl alcohol, normal butanol, isobutanol, etc. in consideration of the compatibility with the binder resin. The addition amount is properly adjusted in accordance with the viscosity of the target paste or the ink.

As shown in FIG. 1, the spacer 6 is provided to keep a desired gap 5 between the pressure-sensitive resistors 4 when the pair of base films 2 each of which has the electrode 3 and the pressure-sensitive resistor 4 formed on the confronting surface thereof are disposed so that the pressure-sensitive resistors 4 face each other. As the spacer 6, an adhesive for print which is formed of acrylic resin or the like, a laminate film of thermo-compression agent, a PET having adhesive layers on both sides thereof or the like can be used. As shown in FIG. 2, the spacer 6 is formed in a C-shape so as to surround the electrodes 3 and the pressure-sensitive resistors 4 in a larger inner diameter so that the spacer 6 is not overlapped with the electrodes 3 and the pressure-sensitive resistors 4.

In the pressure-sensitive sensor 1 having the above-described structure, when a pressure is applied to the base film 2, the base film 2 is deformed in accordance with the applied pressure, and the contact state between the pressure-sensitive resistors 4 is varied. Accordingly, the resistance value between the electrodes 3 is varied in accordance with the applied pressure, and thus the applied pressure can be detected on the basis of the resistance value.

Next, an example of the method of manufacturing the pressure-sensitive resistor 4 will be briefly described.

First, the electrical conductive particles are coated by polymer. The slurry obtained by mixing carbon black as electrical conductive particles having a primary particle diameter and water is mixed and stirred with epoxy resin solution obtained by mixing and dissolving epoxy resin as polymer in toluene. The carbon black and the epoxy resin are granulated, and the obtained granules are separated, thereby obtaining carbon black coated by the epoxy resin. Here, the primary particle diameter of the electrical conductive particles is set in a range from 8 nm to 300 nm, and preferably in a range from 15 nm to 100 nm.

Predetermined amounts of the binder resin and the organic solvent are weighed and mixed with each other to obtain a mixture solution. Thereafter, a predetermined amount of the carbon black coated by epoxy resin is added to the mixture solution, and well blended and dispersed by three-roll mills or the like. In the pressure range of 1 to 20 kPa, the thickness of the polymer coating on the electrical conductive particles is set to a value in a range between 10 nm and 20 nm in order to increase the resistance variation rate (pressure sensitivity) of the pressure-resistance characteristic of the pressure-sensitive resistor 4 in the detectable range of the resistance value. At this time, in order to form the above polymer thickness, the addition amounts of the electrical conductive particles and the binder resin are determined so that the amount of the polymer coated on the electrical conductive particles is set in the range from 1 wt % to 70 wt % with respect to the total amount of the electrical conductive particles and the binder resin. At this time, in order to achieve a larger tunnel conduction effect, the addition amounts of the electrical conductive particles and the binder resin are determined so that the amount of the polymer is set in the range from 1 wt % to 50 wt % with respect to the total amount of the electrical conductive particles and the binder resin.

After the blend/dispersion, resistant paste having a predetermined viscosity is obtained by using a kneading machine such as a stone mill or the like, and it is pattern-printed by the screen printing method so as to have a WET film thickness of several μm to several tens μm and to cover the surface of the electrode 3 formed on the base film 2. The printed resistant paste is held and dried at a temperature of 50 to 200° C. for 0.5 to 3 h, thereby forming the pressure-sensitive sensor 1 having the pressure-sensitive resistor 4. When thermosetting resin is used, a batch type furnace, a belt furnace, a far infrared radiation furnace or the like is used and the thermosetting resin is cured (hardened) simultaneously with drying of the resistant paste.

Figure 3A:
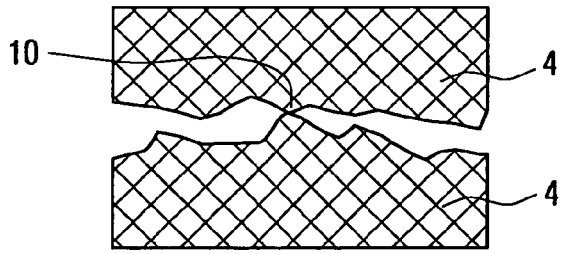
FIG. 3A is a schematic view for explaining an effect of an elastic modulus of a binder resin.
Figure 3B:
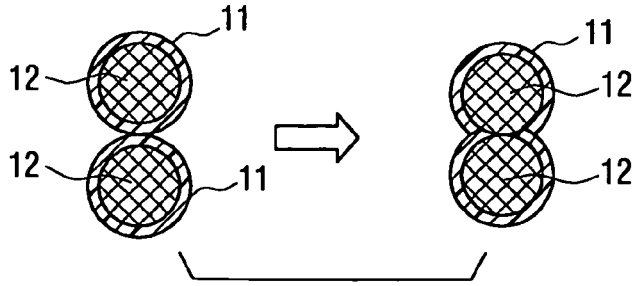
FIG. 3B is a schematic view for explaining an effect of a polymer coating, according to the embodiment.

Here, the effect on the pressure-resistance characteristic by the coating of polymer on electrical conductive particles and the effect of the elastic modulus of the binder resin will be described with reference to FIGS. 3A and 3B. FIG. 3A is a schematic view for explaining the effect of the elastic modulus of the binder resin, and FIG. 3B is a schematic view for explaining the effect of the polymer coating.

In the pressure-sensitive sensor 1 having the pressure-sensitive resistor 4, when pressure is applied to the base film 2, the base film 2 is deformed, and the electrode 3 and the pressure-sensitive resistor 4 formed on the surface of the base film 2 are also deformed. At this time, the confronting pressure-sensitive resistors 4 start to partially come into contact with each other, and the true contact area resistance (concentrated resistance) is dominantly varied with respect to the application of the pressure at the initial stage of the contact. When pressure is further applied, the pressure-sensitive resistor 4 is deformed, and the contact area of the upper and lower pressure-sensitive resistor 4 is increased, so that the true contact area resistance is reduced. At this time, by the deformation of the pressure-sensitive resistor 4, the contact pressure is applied to the electrical conductive particles coated with polymer at the contact position on the surface of the pressure-sensitive resistor 4, and the distance between the electrical conductive particles is reduced. Therefore, the tunnel conduction between the electrical conductive particles is increased, and the coating resistance is reduced.

As described above, the pressure-sensitive sensor 1 according to this embodiment detects the applied pressure on the basis of the variation of the value (surface contact resistance) obtained by adding the true contact area resistance (or the concentrated resistance) caused by the contact area between the actual pressure-sensitive resistors 4 with the coating resistance of the electrical conductive particles between the surfaces of the contacted pressure-sensitive resistors 4.

Viewing the surface of the pressure-sensitive resistor 4 microscopically, it has an uneven shape as shown in FIG. 3A. When pressure is applied, the contact occurs at an uneven portion 10 at which the distance between the pressure-sensitive resistors 4 is shortest as shown in FIG. 3A. Here, when a pressure in the range from 1 to 20 kPa is applied, the binder resin would be hardly deformed in accordance with the pressure at the lower pressure side of the pressure range described above if the elastic modulus of the binder resin is larger than 1000 MPa, and thus the contact area is very small. Accordingly, the resistance value based on the true contact area resistance exceeds the detectable range ($10^6\Omega$). Furthermore, if the elastic modulus of the binder resin is less than 10 MPa, the binder resin is easily deformed with slight pressure, and thus the contact area is saturated at the lower pressure side of the pressure range described above. Accordingly, when the pressure is further increased, the resistance variation is hardly observed because the true contact area resistance is saturated.

The pressure-sensitive resistor 4 and the pressure-sensitive sensor 1 according to this embodiment uses the binder resin whose elastic modulus ranges from not less than 10 MPa to not more than 1000 MPa. Accordingly, when the pressure in the range from 1 to 20 kPa is applied, the resistance value based on a proper true contact area initially is generated with respect to pressure at the low pressure side of the range, and the contact area between the pressure-sensitive resistors 4 is not saturated and the resistance value is varied in accordance with the pressure at the high pressure side. Therefore, the resistance value can be varied in accordance with the applied pressure.

As shown in FIG. 3B, the surfaces of the electrical conductive particles 12 of the pressure-sensitive resistors 4 of this embodiment are coated by polymer 11. Accordingly, as shown in FIG. 3B, when the pressure applied in the range from 1 to 20 kPa is increased, the contact pressure is applied to the electrical conductive particles 12 coated by the polymer 11 on the surfaces of the pressure-sensitive resistors 4 which come into contact with each other, so that the tunnel conduction between the two electrical conductive particles 12 is increased and also the coating resistance is reduced. Accordingly, by the variation of the coating resistance as described above, the resistance variation rate can be increased in the resistance-value detectable range of the pressure range from 1 to 20 kPa by adding the true contact area resistance with the coating resistance in the pressure-sensitive resistors 4 of this embodiment.

The pressure-sensitive resistor 4 and the pressure-sensitive sensor 1 having the pressure-sensitive resistors 4 according to this embodiment have the polymer 11 on the surface of each electrical conductive particle 12, and the elastic modulus of the binder resin is set in the range from not less than 10 MPa to not more than 1000 Mpa (10 Mpa–1000 Mpa). Therefore, the pressure in the range from 1 to 20 kPa can be detected with a high sensitivity.

It is more preferable that the elastic modulus of the binder resin ranges from 10 MPa to less than 800 MPa. When the elastic modulus is set in the range from not less than 800 MPa to not more than 1000 MPa, the uneven portion 10 of the pressure-sensitive resistor 4 is not readily deformed and the effect of the coating resistance variation is hardly obtained particularly at the low pressure side at which the applied pressure is in the range 1 to 20 kPa. Accordingly, if the elastic modulus of the binder resin ranges from not less than 10 MPa to less than 800 MPa, the effect of the coating resistance variation can be obtained from the lower pressure side, and the pressure-resistance characteristic in the range from 1 to 20 kPa can be made smoother.

Figure 4A:
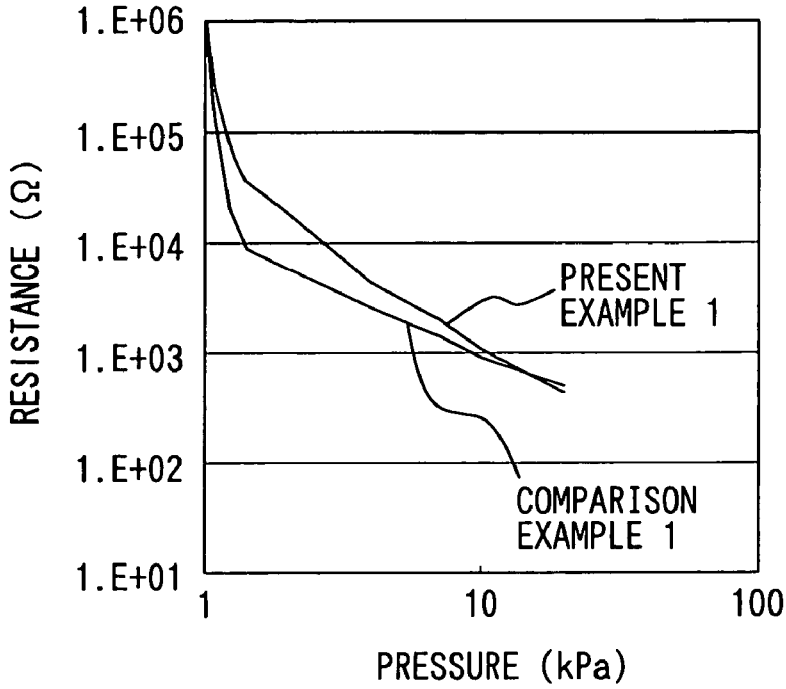
FIG. 4A is a graph showing pressure-resistance characteristics with a presence and an absence of a polymer in a case where the elastic modulus of binder resin is equal to 1000 Mpa.
Figure 4B:
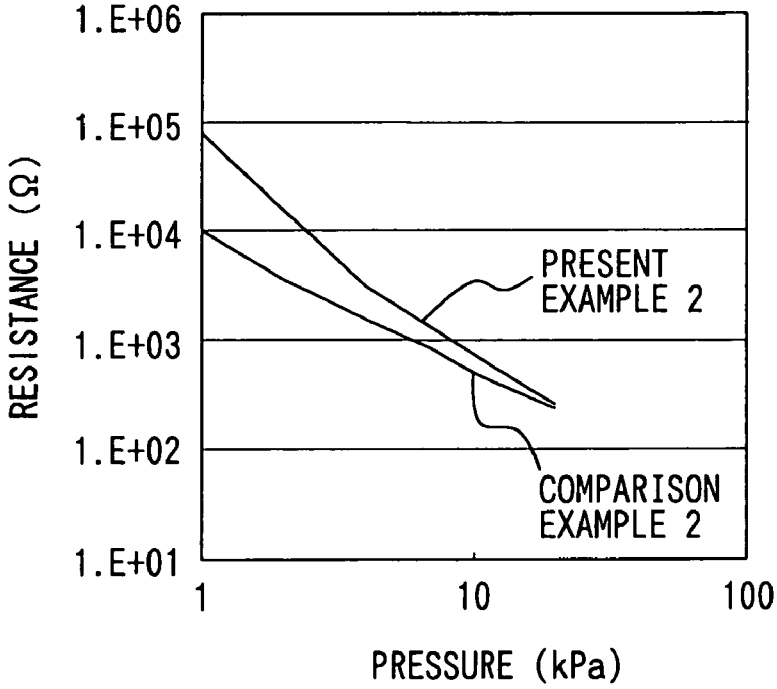
FIG. 4B is a graph showing pressure-resistance characteristics with the presence and the absence of a polymer in a case where the elastic modulus of the binder resin is equal to 200 Mpa.
Figure 5:
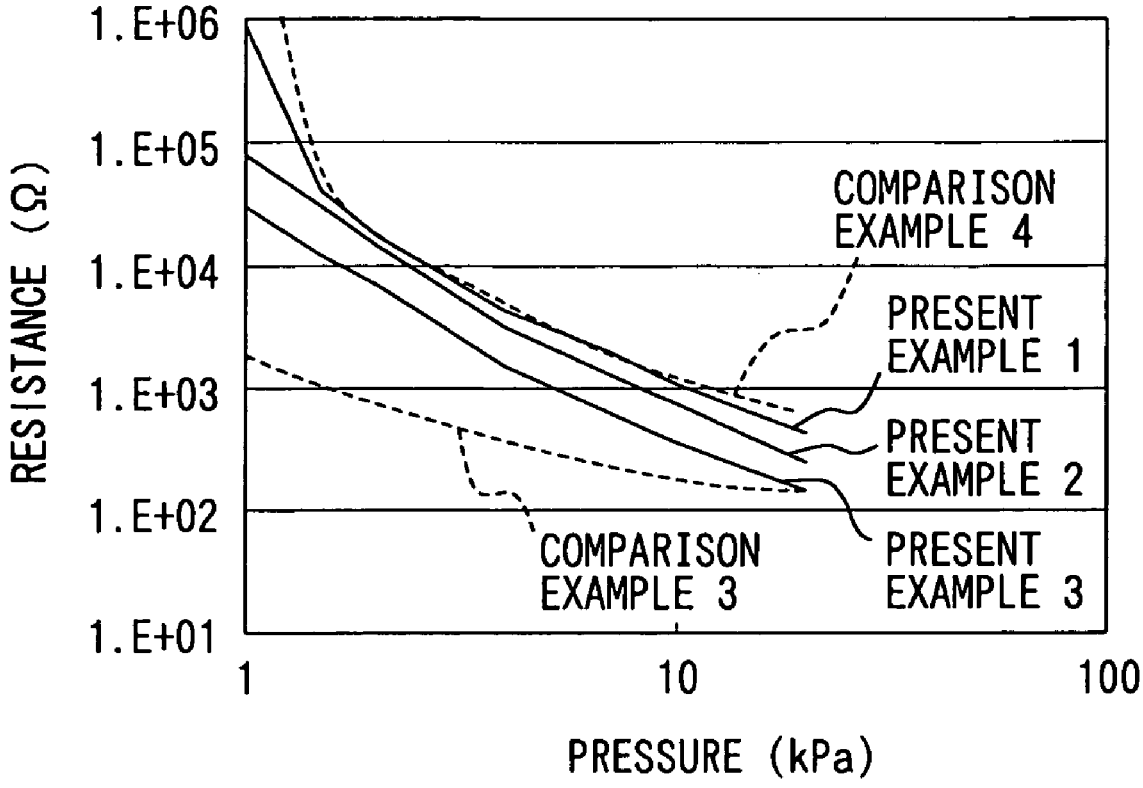
FIG. 5 is a graph showing pressure-resistance characteristics due to the elastic modulus of the binder resin, according to the embodiment.

Here, the resistance value variation in the pressure range from 1 to 20 kPa was checked in the pressure-sensitive sensor 1 having the pressure-sensitive resistor 4 formed according to this embodiment. FIGS. 4A, 4B and 5 show the results of the embodiment. FIGS. 4A, 4B are graphs showing the pressure-resistance characteristic in accordance with the presence or absence of polymer. More specifically, FIG. 4A shows a case where the elastic modulus of the binder resin is equal to 1000 MPa, and FIG. 4B shows a case where the elastic modulus of the binder resin is equal to 200 MPa. FIG. 5 is a graph showing the pressure-resistance characteristic in accordance with the elastic modulus of the binder resin.

As the binder resin, an urethane resin having an elastic modulus of 1000 MPa is used as Present Example 1 of this embodiment, an urethane resin having an elastic modulus of 200 MPa is used as Present Example 2 of this embodiment, and an urethane resin having an elastic modulus of 10 MPa is used as Present Example 3 of this embodiment. As the electrical conductive particles 12, carbon black (MAB produced by Mitsubishi Chemicals Co., Ltd.) coated with epoxy resin (Epicoat produced by Japan Epoxy Resin Co., Ltd.) is used. In this electrical conductive particles 12, the primary particle diameter is equal to about 24 nm and the structure (DBP absorption amount) is equal to about 60 ml/100 g. The blend ratio of the carbon black (containing polymer coating) and the urethane resin is set to 47.5:52.5, and the amount of the polymer coating is set to 10 wt % of the total amount of the carbon black and the epoxy resin. Then, the pressure-sensitive sensor 1 having the pressure-sensitive resistor 4 is manufactured according to the manufacturing method of this embodiment, and the resistance value was measured while pressure in the range from 1 to 20 kPa is applied.

In the pressure-sensitive sensors 1 of the first to third Present Examples of this embodiment, PET of 75 μm in thickness is used as the base film 2, and Ag is used as the electrode 3. Furthermore, polyester type resin of 40 μm in thickness is attached as the spacer 6 between the confronting surfaces of a pair of base films 2, and the ratio (aspect ratio) of the diameter of the upper and lower surfaces of the gap 5 to the thickness (in the laminate direction) of the gap is set to 300.

As Comparison Examples of the Present Examples 1 and 2 of this embodiment, pressure-sensitive sensors 1 are manufactured by using carbon black coated with no epoxy resin, and the measurement results of the sensors 1 concerned are shown as Comparison Examples 1 and 2.

As shown in FIGS. 4A and 4B, it is apparent that the resistance variation rate is increased within the resistance-detectable range in the pressure-sensitive sensors 1 of the Present Examples 1 and 2 as compared with the Comparison Examples 1 and 2 using the electrical conductive particles 12 having no polymer coating. However, in the case of the Present Example 1, the elastic modulus of the binder resin is equal to 1000 MPa, and the pressure-sensitive resistor 4 is hardly deformed under a low pressure, and thus the effect of the coating resistance variation by the polymer coating is reduced in the low pressure area as shown in FIG. 4A. On the other hand, in the case of Present Example 2, the effect of the coating resistance variation is observed in the low pressure area as shown in FIG. 4B, and thus this is more preferable.

Subsequently, pressure-sensitive sensors 1 are manufactured by using binder resin having an elastic modulus of 1 MPa and 2000 MPa, and measurement results obtained by these sensors 1 are set as Comparison Examples 3, 4. In the Comparison Example 3, silicon resin is used as the binder resin in place of urethane resin and the blend ratio between carbon black (containing polymer coating) and silicon resin is set to 15/85. In the Comparison Example 4, polyester resin is used as the binder resin in place of urethane resin, and the blend ratio between carbon black (containing polymer coating) and polyester resin is set to 15/85.

As shown in FIG. 5, the Present Examples 1 to 3 used the binder resin whose elastic modulus is set in the range from 10 to 1000 MPa, and in the pressure range of 1 to 20 kPa, these Present Examples 1 to 3 show an approximate linear resistance variation and a large resistance variation rate in the resistance detectable range. On the other hand, the Comparison Example 3 using the binder resin having an elastic modulus of 1 MPa has a smooth resistance variation, and it has little resistance variation when the pressure is equal to 10 kPa or more. In the case of the Comparison Example 4 in which the binder resin whose elastic modulus was 2000 MPa is used, the initial resistance value under pressure of about 1 kPa exceeded $10^6$ Ω, and thus it is difficult to measure the resistance value.

As described above, in the pressure range of 1 to 20 kPa, the pressure-sensitive resistor 4 and the pressure-sensitive sensor 1 according to this embodiment can have the linear pressure-resistance characteristic and the large resistance variation rate in the resistance-detectable range. That is, the pressure in the range from 1 to 20 kPa can be detected with a high sensitivity.

Although the present invention has been fully described in connection with the preferred embodiment thereof with reference to the accompanying drawings, it is to be noted that various changes and modifications will become apparent to those skilled in the art.

For example, in the above-described embodiment, when the resistance paste is formed to form the pressure-sensitive resistor, the resistance paste is composed of the electrical conductive particles coated with polymer, the binder resin and the solvent. However, in addition to these elements, a dispersant can be added to enhance the dispersibility of the electrical conductive particles coated with the polymer, or a spherical filling material or the like can be added to assist the pressure-sensitive characteristic.

The pressure-sensitive resistor 4 and the pressure-sensitive sensor 1 having the pressure-sensitive resistor 4 of the above-described embodiment can detect the pressure in the range from 1 to 20 kPa with high sensitivity, but the pressure detecting range (use range) is not limited to the range from 1 to 20 kPa.

Furthermore, in the pressure-sensitive sensor 1 of this embodiment, the ratio (aspect ratio) of the diameter of the upper and lower surfaces of the gap to the thickness (in the laminate direction) of the gap is set to 300. However, the aspect ratio is not limited to 300. Accordingly, the aspect ratio can be determined in combination with the elastic modulus of the binder resin. For example, when the detection is started from a pressure side which is slightly lower than 1 kPa, the aspect ratio can be set to a value larger than 300.

Such changes and modifications are to be understood as being within the scope of the present invention as defined by the appended claims.

What is claimed is:

1. A pressure-sensitive resistor for a pressure-sensitive sensor that includes a pair of electrodes provided on first and second base films, respectively, between the first and second base films, the pressure-sensitive resistor provided by one layer on one of the electrodes to form a predetermined gap between the one layer of the pressure-sensitive resistor and the other electrode or by two layers on the electrodes to form a predetermined gap between the two layers, the pressure-sensitive resistor comprising:

a binder resin having an elasticity modulus in a range between 10 and 1000 Mpa; and a plurality of coated particles each of which includes an electrical conductive particle and a polymer layer coated on the electrical conductive particle, wherein the coated particles are dispersed in the binder resin.

2. The pressure-sensitive resistor according to claim 1, wherein the electrical conductive particles are carbon black particles.

3. The pressure-sensitive resistor according to claim 1, wherein the electrical conductive particles have a primary particle diameter that is in a range between 8 nm and 300 nm.

4. The pressure-sensitive resistor according to claim 3, wherein the primary particle diameter of the electrical conductive particles is in a range between 15 nm and 100 nm.

5. The pressure-sensitive resistor according to claim 1, wherein an amount of the polymer coated on the electrical conductive particles is in a range between 1 wt % and 70 wt % with respect to a total amount of the electrical conductive particles and the binder resin.

6. The pressure-sensitive resistor according to claim 5, wherein the amount of the polymer coated on the electrical conductive particles is in a range between 1 wt % and 50 wt % with respect to the total amount of the electrical conductive particles and the binder resin.

7. A pressure-sensitive sensor comprising:

first and second base films opposite to each other;

a pair of electrodes provided on first and second base films, respectively, between the first and second base films; and first and second pressure-sensitive resistors provided by two layers on the electrodes to form a predetermined gap between the first and second pressure-sensitive resistors, wherein:

a contact state between the first and second pressure-sensitive resistors is changed in accordance with a pressure applied to at least one of the first and second base films;

the electrodes are provided to change a resistance therebetween in accordance with the contact state between the first and second pressure-sensitive resistors; and each of the first and second pressure-sensitive resistors is constructed with a binder resin having an elasticity modulus in a range between 10 and 1000 Mpa, and a plurality of coated particles each of which includes an electrical conductive particle and a polymer layer coated on the electrical conductive particle, wherein the coated particles are dispersed in the binder resin.

8. The pressure-sensitive sensor according to claim 7, wherein the electrical conductive particles are carbon black particles.

9. The pressure-sensitive sensor according to claim 7, wherein the electrical conductive particles have a primary particle diameter that is in a range between 8 nm and 300 nm.

10. The pressure-sensitive sensor according to claim 7, wherein an amount of the polymer coated on the electrical conductive particles is in a range between 1 wt % and 70 wt % with respect to a total amount of the electrical conductive particles and the binder resin.

11. The pressure-sensitive sensor according to claim 7, further comprising a spacer disposed between the first and second base films so as to form the predetermined gap between the first and second pressure-sensitive resistors.

12. A pressure-sensitive sensor comprising:

first and second base films opposite to each other;

a pair of electrodes provided on first and second base films, respectively, between the first and second base films; and a pressure-sensitive resistor provided by one layer on one of the electrodes to form a predetermined gap between the pressure-sensitive resistor and the other one of the electrodes, wherein:

a contact state between the pressure-sensitive resistor and the other one of the electrodes is changed in accordance with a pressure applied to at least one of the first and second base films;

the electrodes are provided to change a resistance therebetween in accordance with the contact state between the pressure-sensitive resistor and the other one of the electrodes; and the pressure-sensitive resistor is constructed with a binder resin having an elasticity modulus in a range between 10 and 1000 Mpa, and a plurality of coated particles each of which includes an electrical conductive particle and a polymer layer coated on the electrical conductive particle, wherein the coated particles are dispersed in the binder resin.

13. The pressure-sensitive resistor according to claim 1, wherein the polymer layer coated on the electrical conductive particle is made of a polymer different from the binder resin.

14. The pressure-sensitive resistor according to claim 7, wherein the polymer layer coated on the electrical conductive particle is made of a polymer different from the binder resin.

15. The pressure-sensitive resistor according to claim 12, wherein the polymer layer coated on the electrical conductive particle is made of a polymer different from the binder resin.

* * * * *